United States Patent [19]

Ho Lee

[11] 3,934,293

[45] Jan. 27, 1976

[54] FEEDING DEVICE FOR WIRE STOCK IN A HIGH SPEED COLD HEADING DEVICE

[76] Inventor: Yuan Ho Lee, 85, Jen Ho Road, Tainan, China /Taiwan

[22] Filed: Aug. 6, 1974

[21] Appl. No.: 495,141

[52] U.S. Cl. ..... 10/13; 10/25

[51] Int. Cl.[2] ..... B21K 1/44; B23G 11/00

[58] Field of Search..... 10/11 R, 11 M, 11 T, 12 R, 10/12.5, 13, 15, 25, 162 A, 162 R

[56] References Cited

UNITED STATES PATENTS 2,747,205 5/1956 Fray ..... 10/13

2,768,394 10/1956 Ward ..... 10/13

*Primary Examiner*—C. W. Lanham
*Assistant Examiner*—E. M. Combs
*Attorney, Agent, or Firm*—Lane, Aitken, Dunner & Ziems

[57] ABSTRACT

A device for feeding wire stock of fixed length to a cutoff tool in a linear and continuous manner by means of the reciprocating motion of a wire cutting mechanism driven by an eccentric shaft being utilized to sever and sequentially feed the cutoff wire stock one at a time to a die head.

7 Claims, 6 Drawing Figures

FEEDING DEVICE FOR WIRE STOCK IN A HIGH SPEED COLD HEADING DEVICE

BACKGROUND OF THE INVENTION

A conventional blank cutoff and feeding device for heading machines is shown in FIG. 1. The upper and lower faces of a semi-circular cutoff tool 2 at the front end of a wire cutting shaft 1 are provided with a pair of spring loaded grippers 3, which, when wire stock 4 has been cut off to fixed length, hold the severed blank and transfer it to a position upon a die 7 where the first stage of the operation will be performed. The pitch between the wire cutting operation and the first stage operation is quite long, that is, the transfer distance is rather long. Therefore, errors will occur frequently during the operation. Furthermore, the wire cutting and the transferring work for cutoff stocks usually can not be coordinated with the processing time for impacting the head of the wire stock into the desired shape. Thus, the efficiency of the heading machine is greatly reduced.

In addition, the roller 8 is pivotedly connected in a body with the vertical lower end of the wire cutting shaft 1 and at the same time, the roller 8 protrudes into a guide groove 9 of a sliding plate 5 under the wire cutting shaft 1 and slides reciprocally in a direction which is at right angles in respect with the wire cutting shaft 1. When the sliding plate 5 starts its reciprocating motion by means of the driving of a crank plate via a connecting rod 6, the roller 8 which is secured in a body with the wire cutting shaft 1 causes the wire cutting shaft 1 to move back and forth to accomplish the purpose of cutting wire stock to a fixed length and transferring the cutoff blank. It is quite evident that the mechanism used in the prior art has the deficiency of complexity and inaccuracy, together with fast wearing of the associated parts during operation. Consequently, it is very difficult to attain the proper operations in each stage, such as cutting, feeding and upsetting in a regular sequence of timing, so as to reduce the possibility of obtaining a high efficiency in a heading operation.

SUMMARY OF THE INVENTION

The present invention relates to a cutoff blank feeding device used for a rotary type of high-speed cold heading machine and, more particularly, to a cutoff blank feeding device of a heading machine for screws whose body and head are substantially different in size and somewhat complex in their forms. The heading machine herein referred to is capable of forming rivets, tubular rivets, socket-head screws, hexagon-head screws, wood screws and bolts therefor, machine screws, automobile bolts, tapping screws, and screws having cross recess style roundhead, counter-sunk heads, oval heads, square heads and the like.

The principal object of the present invention is to provide an improvement to overcome the defects mentioned above and to provide a device in which, after the wire stock is cut off, a cutting tool is utilized for the push and feed of the cutoff blank forward in a linear and continuous way to a blank stacker and also render the foremost blank properly in alignment with the center of the die opening. Since the stroke of the wire cutting shaft only measures approximately one centimeter, and the wire cutting tool is driven by an eccentric shaft, it is not only possible to obtain a very accurate operation and a good coordination of the respective cutting, conveying and heading processing time, but also possible to accomplish an extremely high-speed and stable heading operation.

A further object of the present invention is to provide a cutoff blank feeding device having a simplified construction, which produces no malfunctions, long life and having a high product quality when used in a rotary type of highspeed cold heading machine.

BRIEF DESCRIPTION OF THE DRAWINGS

These and other objects and features of the present invention will become more apparent from the following description taken in conjunction with the accompanying drawings, in which.

DETAILED DESCRIPTION OF THE PREFERRED EMBODIMENTS

Figure 1A:
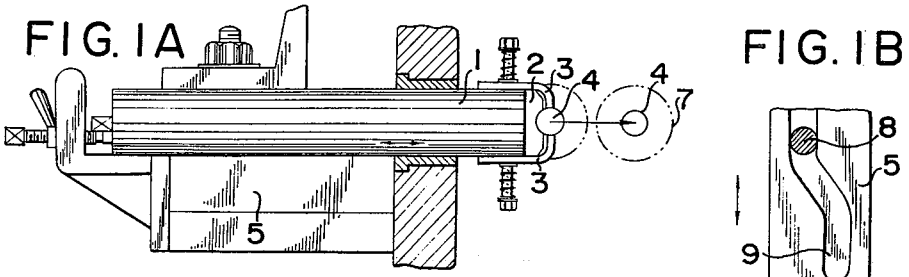
FIG. 1A depicts a front view partially in cross-section of the conventional blank cutoff and feeding device for a heading machine.
Figure 1B:
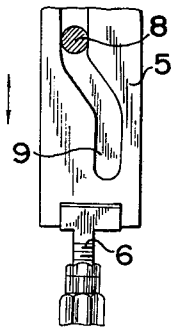
FIG. 1B depicts a plan view of the sliding plate of FIG. 1A.

In the figures the primary source of driving force is the main eccentric shaft 20 driven by its V-belt pulley 13 through a V-belt pulley 11 a motor 10 via the V-belt 12. A bevel gear 21 and a spur gear 22 are keyed on the main eccentric shaft 20. A main sliding block 30 having a punching means (not shown) is driven by a connecting member 31 which is pivotedly fixed to the other end 20' of the main eccentric shaft 20 for performing a back and forth motion of the punching means. The bevel gear 21 on the main eccentric shaft 20 is engaged with a bevel gear 41 on a shaft 40 to drive the wire-cutting eccentric shaft 40. A connecting member 42, through which is pivotedly fixed a reciprocating wire-cutting shaft 50, is also mounted on the shaft 40. A generally U-shaped cutting tool 51 is fixed to the end of the shaft 50. An eccentric disc 43 is mounted at the further end of the eccentric shaft 40 by means a fixing key. One end of a connecting rod 44 is pivotedly connected to the eccentric disc 43. The other end of the connecting rod 44 includes a frictional connecting rod 61 having a friction plate which is positioned at the interior of a rotary die head 60. The rotary die head 60 is actuated through the connecting rod 44 and its accessories. A knockout mechanism 82 and rollers 92 are provided for feeding wire stock 90 into a die head through a straightener 91.

Figure 2:
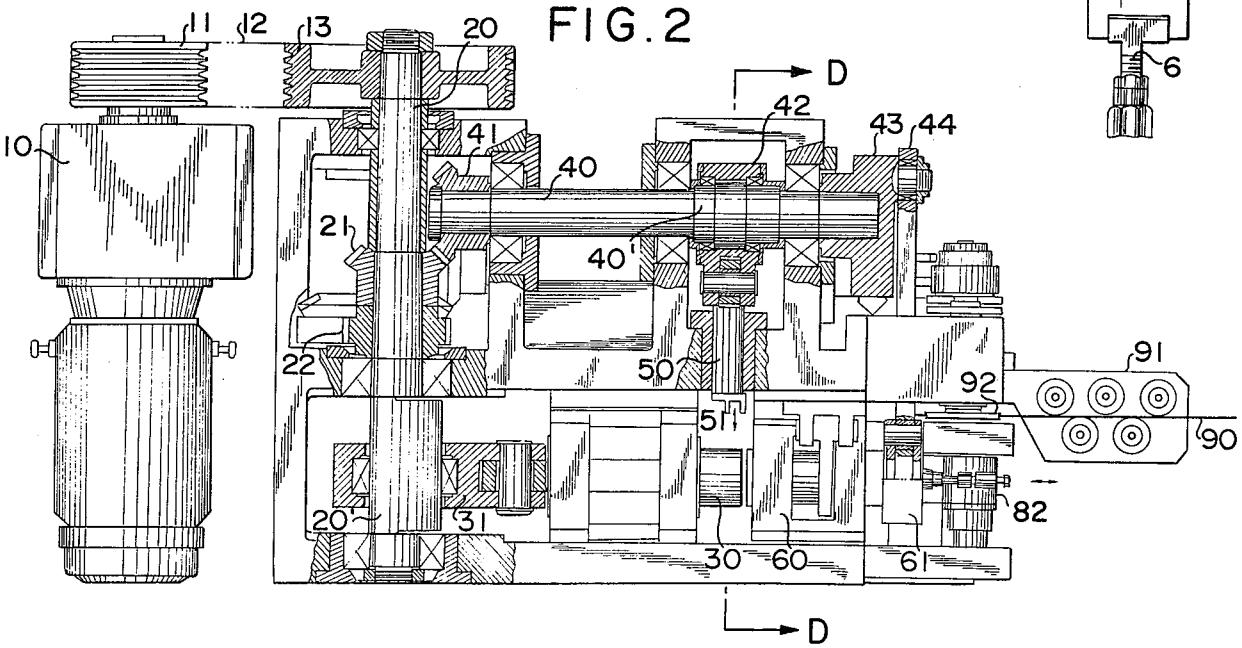
FIG. 2 depicts a plan view partially in cross-section of a rotary type of high-speed heading machine in which the blank cutoff and feeding device of the present invention is used.
Figure 3:
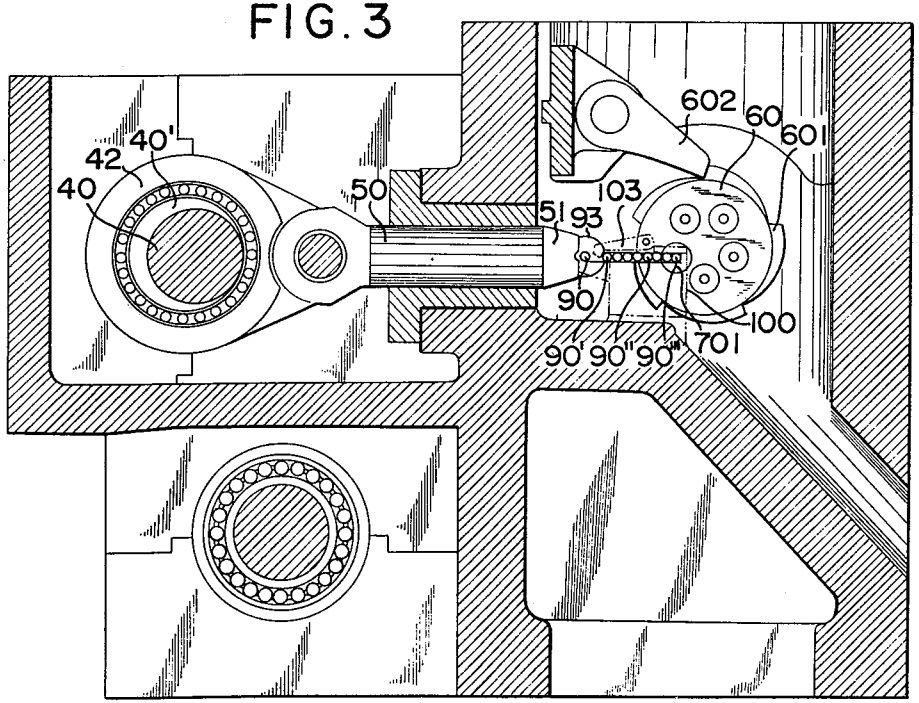
FIG. 3 depicts a cross-sectional view taken along line D—D of FIG. 2.
Figures 4A, 4B:
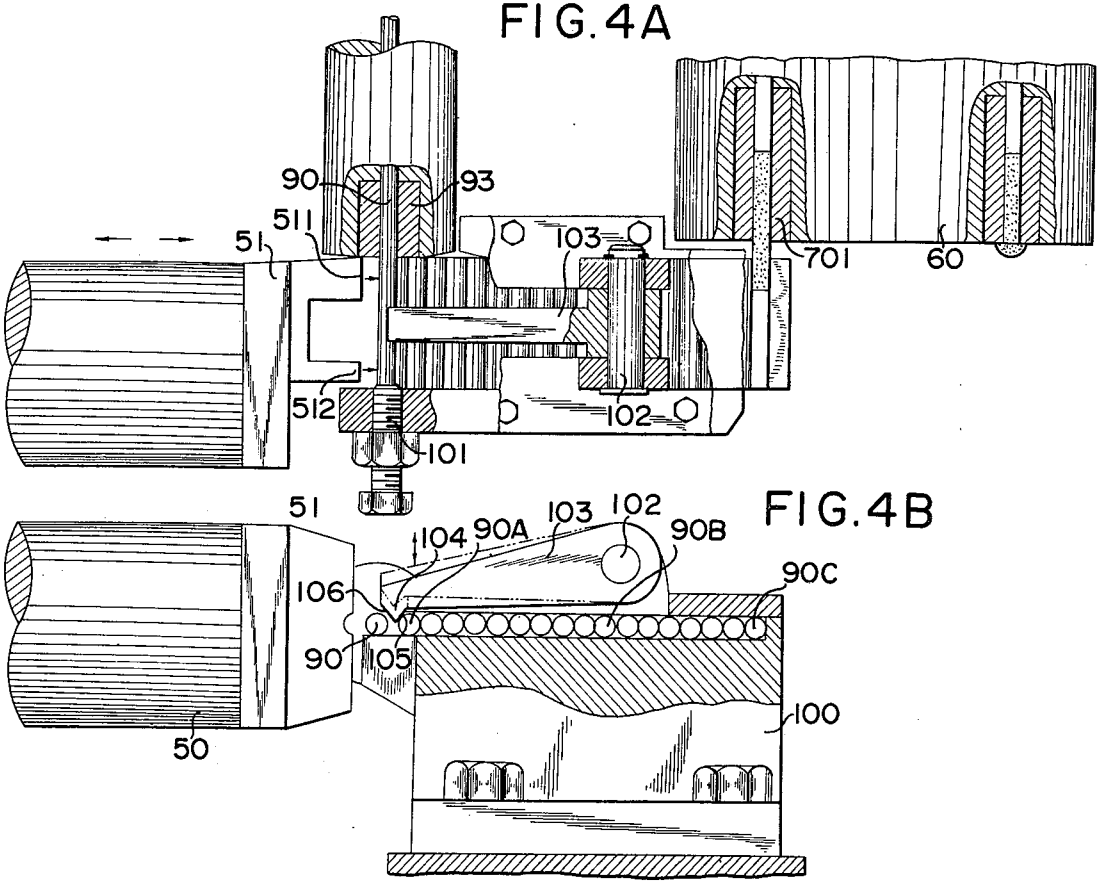
FIG. 4A depicts an enlarged detailed plan view partially in cross-section of the blank cutoff and feeding device of the present invention.
FIG. 4B depicts a side view of the device as shown in FIG. 4A.

According to the present invention, FIG. 3 represents an enlarged cross-sectional view from the line D—D in FIG. 2. FIG. 4 is a partial cross-sectional view of the blank cutoff and feeding device. After the wire stock 90 is fed in through the straightener 92 and is passed through a cutting die 93, the stock 90 contacts a stopper 101 provided at the rear side of the cutoff blank stacker 100 relative to the forward direction of the wire stock for adjusting the desired length of a cutoff blank 90A. As the wire cutting shaft 50 moves forward and cuts off the fed wire stock into a pre-determined length by means of the U-shaped semi-circular cutting tool 51 fitted at the front end thereof, the two protruding arms 511 and 512 on the U-shaped semi-circular cutting tool 51 are then holding and pushing the two ends of a cutoff blank 90B forward in a parallel and accurate way into the cutoff blank stacker 100 with a uniform and equal force.

A retaining arm 103 having its lower foremost pointed end 104 formed with inner and outer inclined surfaces 105 and 106, respectively is provided at the upper part of the cutoff blank stacker 100 with a pivot 102 mounted above the said stacker 100 as its fulcrum. The arm 103 is able to move up and down for retaining and holding the cutoff blanks 90B tightly within the stacker 100 so as to make the cutoff blanks 90B closely stacked one by one in a linear arrangement and to position the center line of the foremost cutoff blank 90C on the stacker 100 properly in alignment with a die opening 701 of the rotary die head 60. A ram rod of the main sliding block 30 then pushes the foremost cutoff blank 90C into the die opening 701. In practice, only a moving distance of approximately 1 centimeter is sufficiently enough for the wire cutting shaft 50 to accomplish the heading work. Also, the coordination of the timing of wire cutting, feeding and heading work stages in regular sequence is very easily to be obtained, and its simplified construction and accurate operation do not call for highly skilled operators in order to obtain speedy and stable heading production.

I claim:

1. In a heading machine for making headed goods from wire stock, the combination comprising:

a frame;

first eccentric driving means connected to a source of power by connecting means;

cutting die means;

means for feeding said wire stock into said cutting die means;

reciprocating cutting means including a cutting tool, said reciprocating cutting means being driven in a reciprocating fashion by second eccentric driving means connected to said first eccentric driving means for cutting the stock produced from said cutting die means to form cutoff blank pieces from said wire stock;

means for contacting the foremost end of said wire stock to adjust the length of said cutoff blank pieces;

stacker means for directly receiving the cutoff blank pieces from and at a position opposite said reciprocal cutting means;

retaining means pivotedly mounted on said stacker means for retaining and holding the cutoff blank pieces one by one in a closely stacked substantially horizontal linear arrangement within said stacker means so that the foremost one of said cutoff blank pieces within said stacker is positioned in alignment with the center line of a die opening in a rotary die head;

said rotary die head having a plurality of die openings, and being actuated in an intermittent manner by an eccentric member driven by said second eccentric driving means; and pushing means driven in a reciprocating manner by a connection engaged to the other end of said first eccentric driving means for directly causing the foremost one of said cutoff blank pieces within said stacker means to be pushed directly into one of said die openings by said pushing means.

2. The heading machine as set forth in claim 1 wherein said reciprocating cutting means further includes means for pushing and feeding the wire stock cut by said cutting tool at a predetermined length forward one by one into said stacker means so that a plurality of cutoff blanks are closely packed in a linear arrangement therewithin, and means to position the center line of the foremost cutoff blank piece in alignment with the die opening in the rotary index head.

3. A heading machine as set forth in claim 1, characterized in that said retaining means comprises a retaining arm having a lower foremost pointed end formed with inner and outer inclined surfaces for holding the cutoff blank which is immediately cutoff from said reciprocal cutting means, and the rear end thereof pivotedly mounted above said stacker means with a pivot as a fulcrum so as to enable said retaining means to move up and down during the cutting operation for holding said cutoff blank pieces closely stacked one by one in a linear arrangement within said stacker.

4. In a cold heading machine for producing articles from wire stock, the combination comprising:

a rotary die head including a plurality of cutoff blank receiving openings therein;

cutting die means for receiving said wire stock and retaining same for cutting into predetermined lengths of cutoff blank pieces;

cutting means, including a cutting tool for cutting said wire stock while retained in said cutting die means, said cutting tool including holding means for holding and advancing the cutoff blank pieces;

stacking means for sequentially receiving said cutoff blank pieces directly from said holding means, said stacking means including retaining means for retaining and holding said cutoff blank pieces within said stacker means in a closely-stacked substantially horizontal linear relationship so that the foremost one of said cutoff blank pieces is accurately aligned with a die opening in the rotary die head; and transfer means for directly transferring the foremost cutoff blank piece from the stacker means to the die opening in said rotary die head.

5. The machine as set forth in claim 4 wherein said cutting tool is a generally U-shaped cutting tool including a pair of protruding arms thereon for holding and advancing said cutoff blank pieces.

6. The machine as set forth in claim 4 wherein said stacking means includes a generally horizontal opening therein for receiving said cutoff blank pieces, said retaining means including a retaining arm pivotedly connected so that a forward portion of said arm cooperates with a receiving portion of said horizontal opening to repetitively move relative thereto to retain and hold cutoff blanks tightly within said opening.

7. The machine as set forth in claim 4 wherein said forward position of said arm included inner and outer inclined surfaces.

* * * * *